United States Patent [19]

Jarvis

[11] Patent Number: 4,569,523

[45] Date of Patent: Feb. 11, 1986

[54] PUTTER CLUB

[76] Inventor: William J. Jarvis, 3600 Vardon Rd., Rochester, Mich. 48063

[21] Appl. No.: 610,466

[22] Filed: May 15, 1984

[51] Int. Cl.[4] ..... A63B 53/06

[52] U.S. Cl. ..... 273/164; 273/80.1; 273/169

[58] Field of Search ..... 273/80.1, 164, 169, 273/171, 172, 168, 79, 167 F; D21/216, 217, 219, 219

[56] References Cited

U.S. PATENT DOCUMENTS 3,191,936 6/1965 Guier ..... 273/80.1 X
4,314,701 2/1982 Swanson ..... 273/164

FOREIGN PATENT DOCUMENTS 1118181 6/1968 United Kingdom ..... 273/80.1

*Primary Examiner*—George J. Marlo
*Attorney, Agent, or Firm*—Harry R. Dumont

[57] ABSTRACT

A golf club including a shaft and adapter fitted to the lower end of the shaft and having a flat end portion. The putter head includes a central slotted arcuate portion adapted to receive the flat end portion of the adapter slidable therein to provide for angular adjustment of the shaft relative to the head. A lock screw is laterally mounted in the head and engagable with the flat end portion securely hold the club in the selected angular position. The striking face of the putter head comprises a flat central portion with a pair of slanted end portions terminating in an alignment slot on the top of the head for alignment of the ball and centering hit with the striking face.

4 Claims, 4 Drawing Figures

PUTTER CLUB

BACKGROUND OF THE INVENTION

The present invention is an adjustable golf club constructed so that the shaft may be disposed at a number of different angles to the head with a relatively wide range of adjustment. The club may thus be readily adjusted to suit the stance of any golf player which varies with his height. Additionally it may with equal facility be adjusted for right or left hand player use.

The adjustable parts of the putter and shaft are designed to be easily operable and to have a tight and secure holding relationship one to the other when the selected angular position has been reached.

A number of prior art adjustable golf clubs are known in which there is allowed an angular adjustment of the club relative to the head. These patents are of background interest. None of them allows for the ready adjustability and locking required nor for the definition of a central striking face to assure accurate positioning and stroking of the ball. One type of adjustable golf club is shown in U.S. Pat. No. 2,644,689 to H. R. Putnam issued on July 7, 1953. A still further type of adjustable golf club head is disclosed in U.S. Pat. No. 3,430,957 issued to E. R. Andis on Mar. 4, 1969 for "LOCKABLE GOLF CLUB HEAD ADJUSTMENT". In that patent the pocking means operates on a end of the club and is located at the bottom of the club.

A still further type of adjustable golf club is shown in D. F. Warnock U.S. Pat. No. 3,214,170 issued on Oct. 26, 1965 for "ADJUSTABLE GOLF CLUB". This device like the other prior art devices does not have the arrangement of the flat striking face ans slanted ends portions or the centrally located adjustable club end which allow for perfect alignment of the striking face relative to the ball.

A still further type of adjustable golf club is shown in C. S. Bassin U.S. Pat. No. 3,096,982 issued on July 9, 1963 for "ADJUSTABLE GOLF CLUB". The putter head disclosed in this patent does not include the alignment features of slot and tappered end portions that allow for complete adjustability and alignment of the striking face relative to the ball.

SUMMARY OF THE INVENTION

The present invention will be seen to provide a readily adjustable golf club in which the base of the shaft is centered relative to the putter head main body and striking face and in which alignment system is provided that directs the vision of the golfer downwardly to provide optimum line up of the ball relative to the center of the striking face.

BRIEF DESCRIPTION OF THE DRAWINGS

The present invention will now be described with reference to the accompanying written specification and to the drawing in which like numerals are used to indicate like parts through out the several views ans in which.

DETAILED DESCRIPTION OF THE PREFERRED EMBODIMENT

Figure 1:
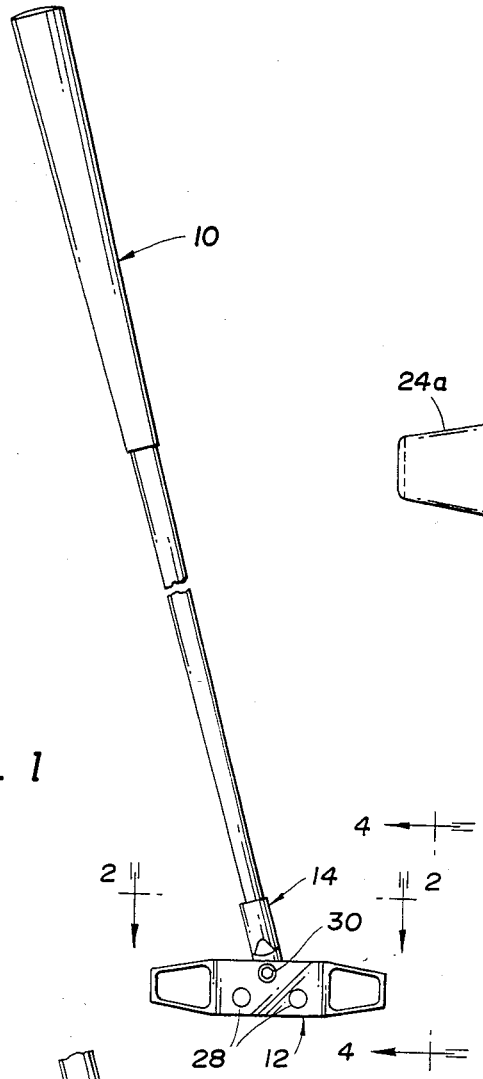
FIG. 1 is a front elevational view showing the shaft and head.
Figure 2:
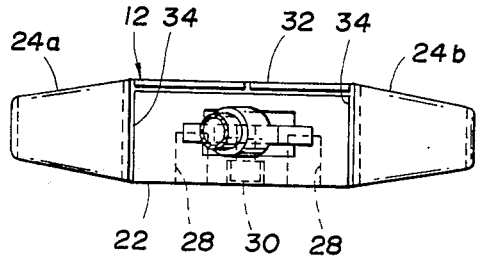
FIG. 2 is a top plan view partly in section taken along section lines 2—2 of FIG. 1.
Figure 3:
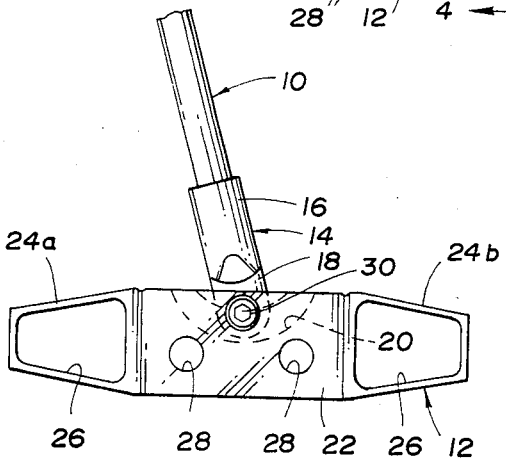
FIG. 3 is a fragmentary view to somewhat larger scale that FIG. 1 showing the detail of the putter head and the arcuate slot.

FIGS. 1 and 2 show the several parts of the golf club which include the shaft 10, the putter head 12 and the adapter 14. The adapter 14 includes an upper cylindrical sleeve end 16 that is press fitted or glued to the lower end of the shaft 10. The adapter 14 terminates in a flat portion 18 which is adapted to slidably engage the arcuate slot 20 in the center of the of the body central body 22 of the putter 12. The putter 12 further includes a pair of slightly tapered end portions 24*a* and 24*b* each of which has formed through it a through channel 26 as shown. Excess metal from the club can be bored out to adjust the weight of the club to the particular person using it and bored out openings 28 are shown. The means for locking the front portion 18 in the arcuate slot 20 at the desired anular position is provided by a lock screw 30 that has its head extending through the back face of the central body 22. FIG. 2 shows the back face 22 and the tapered end portion 24*a* and 24*b* with a striking face identified by the numeral 32. To force the golfer to consciously align the front of the striking face 32 with the ball there are provided a pair of alignment slots 34. The slanting edges of the tapered end portions 24*a*, 24*b* literally cause the golfer to concentrate on locating the putt and centering the ball relative to the striking face 32. This substantially improves the accuracy and predictability of putting and the results.

Figure 4:
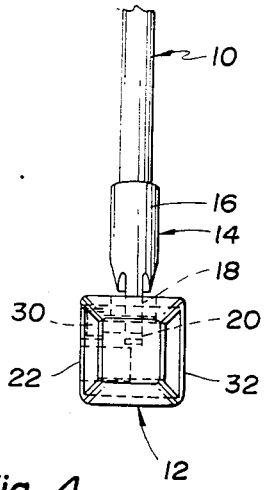
FIG. 4 is a view taken along the line 4—4 of FIG. 1 showing additional detail of the putter head.

FIG. 4 shows the detail of the adaptor 14 with its parts as well as the locking screw 30 which extends through the back face 22. The striking face is shown at the right end edge of the putter head 12 and again identified by the numeral 32. In order to conform to PGA requirements, it is necessary to make the adjustability feature frozen during match play. This is accomplished by sealing the lock screw 30 with solder or with hard setting glue. When readjustment is deemed necessary, the sealer can be removed or the solder melted and the readjustment made.

It will thus be seen that I have provided by my invention an improved an improved adjustable golf club particularly adaptable for use as a putter.

I claim:

1. A golf club comprising:

a putter head having a central body including a striking face and an arcuate slot portion therein;

a shaft including an adapter fixed to its lower end, said adapter having a flat end portion slidably mountable in said arcuate slot portion for angular adjustment of the shaft relative to the putter head;

said head further including on the top surface of its central body a pair of spaced alignment slots to assist in aligning said striking face with the ball and a pair of end portions each respectively abutting one of said slots and including sidewalls converging in a direction toward the outer ends thereof and an upper surface slanted downward toward the outer end thereof for further assisting in setting the ball to the center of the striking surface of the central body.

2. The combination as set forth in claim 1 wherein said adapter includes an upper cylindrical portion press-fitted to the lower end of the shaft.

3. The combination as set forth in claim 1 in which said end portions each have formed therethrough an open channel for material removal and the centering of the striking face of the putter head.

4. The combination as set forth in claim 1 wherein said adapter is locked in place in said arcuate slot by a locking means comprising a set screw.

* * * * *